United States Patent [19]

Ciko et al.

[11] 4,115,281

[45] Sep. 19, 1978

[54] COMPOSITIONS FOR SOURING AND SOFTENING LAUNDERED TEXTILE MATERIALS, METHOD OF PREPARING THE SAME, AND STOCK SOLUTIONS PREPARED THEREFROM

[75] Inventors: John D. Ciko, Allen Park; John J. Cramer; Geoffrey A. Jamieson, both of Wyandotte, all of Mich.

[73] Assignees: BASF Wyandotte Corporation, Wyandotte, Mich.

[21] Appl. No.: 652,558

[22] Filed: Jan. 26, 1976

Related U.S. Application Data

[63] Continuation-in-part of Ser. No. 545,382, Jan. 30, 1975, Pat. No. 4,053,423.

[51] Int. Cl.[2] ..... D06M 13/38

[52] U.S. Cl. ..... 252/8.8; 8/137; 252/8.75; 252/193

[58] Field of Search ..... 252/8.8, 8.6, 8.75, 252/193, 142, 136; 8/137; 260/404.5 EO

[56] References Cited

U.S. PATENT DOCUMENTS

| | | | |
|---|---|---|---|
| 2,525,771 | 10/1950 | Cook | 252/8.8 |
| 3,329,609 | 7/1967 | Blomfield | 252/8.8 |

FOREIGN PATENT DOCUMENTS

| | | | |
|---|---|---|---|
| 657,422 | 9/1951 | United Kingdom | 252/8.8 |

OTHER PUBLICATIONS

Speel et al., Textile Chem. & Auxiliaries (1958) Reinhold Publ. Corp., p. 374.

Cohen et al., Chemistry & Textiles for the Laundry Ind. (1962) Textile Book Publ. Inc., p. 129.

*Primary Examiner*—William E. Schulz

*Attorney, Agent, or Firm*—Bernhard R. Swick; L. S. Van Landingham, Jr.; Robert E. Dunn

[57] ABSTRACT

Liquid and solid compositions are provided for souring and imparting softness to freshly laundered textile materials. When in the form of a stable homogeneous liquid, the composition may contain (a) a quaternized fatty amide, an aqueous emulsion of partially oxidized polyethylene, a fatty amphoteric compound, or a fatty amide as described hereinafter as the softening agent, (b) hydrofluorosilicic acid, ammonium silicofluoride, zinc silicofluoride, ammonium acid fluoride, potassium acid fluoride, or orthophosphoric acid as the souring agent, and (c) water. When in the form of a stable dry solid, the composition may contain (a) a quaternized fatty amide, a fatty amphoteric compound or a fatty amide as described hereinafter as the softening agent, and (b) ammonium silicofluoride, potassium silicofluoride, sodium silicofluoride, zinc silicofluoride, ammonium acid fluoride, sodium acid fluoride or potassium acid fluoride. A method of preparing the liquid composition is provided which insures that it remains stable and homogeneous while awaiting use. Stable homogeneous aqueous stock solutions are also prepared from the liquid or solid compositions of the invention.

54 Claims, 8 Drawing Figures

Figure 1:
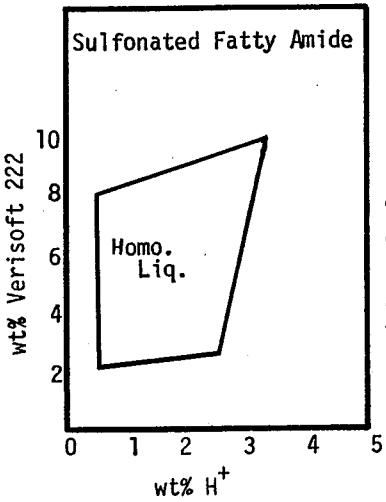

COMPOSITIONS FOR SOURING AND SOFTENING LAUNDERED TEXTILE MATERIALS, METHOD OF PREPARING THE SAME, AND STOCK SOLUTIONS PREPARED THEREFROM

RELATED APPLICATION

This application is a continuation in part of copending application Ser. No. 545,382 filed Jan. 30, 1975 on behalf of John D. Ciko, John J. Cramer and Geoffrey A. Jamieson for "Compositions for Souring and Softening Laundered Textile Materials, Method of Preparing the Same, and Stock Solutions Prepared Therefrom," now U.S. Pat. No. 4,053,423.

THE BACKGROUND OF THE INVENTION

1. The Field of the Invention

This invention broadly relates to compositions for souring laundered textile materials and imparting softness thereto. In one of its more specific aspects, the invention is concerned with a method of preparing novel compositions for use in souring and softening laundered textile materials. The invention is further concerned with stock solutions prepared therefrom.

2. The Prior Art

The fibers of textile materials tend to harden and lose their initial soft finish when laundered repeatedly. The dry laundered textile materials also may be harsh and irritating to the skin under some conditions. As a result, softening finishes are applied for the purpose of imparting or restoring the softness properties. In most commercial laundries the softening finish is applied during the souring operation which follows the washing step and several rinses to remove residual detergent. The final rinse may be the souring operation and the softening finish is conveniently applied at that time.

Quaternized fatty amines are excellent softening agents for textile materials and are widely used for this purpose. However, at best they are only slightly soluble or marginally dispersable in aqueous solutions of inorganic acids of the types most often used in the souring operation and relatively concentrated stable homogeneous liquid compositions or stock solutions cannot be prepared therefrom. It is therefore necessary to make separate additions of the softening agent and the souring agent to the final rinse water in the washer. These separate additions in turn require maintaining separate inventories of the softening agent and the souring agent, separate auxiliary storage facilities therefor while awaiting use, and separate apparatus for making each of the two additions to modern commercial washers.

A suitable stable homogeneous composition containing the proper proportion and concentrations of the softening agent and the souring agent would possess a number of advantages which are attractive from the standpoints of convenience and efficiency. This is especially true when operating modern commercial laundry equipment of the type wherein bulk liquid washing chemicals are stored in auxiliary tanks and are added automatically to the washer through feed conduits at predetermined stages in the washing cycle. Entirely satisfactory compositions having the aforementioned characteristics were not available prior to the present invention due in part to the incompatible nature of the softening agents and the inorganic acid species which are commonly used as souring agents. If available, such compositions would allow the initial construction costs of commercial laundries to be reduced substantially as separate auxiliary apparatus would not be needed for storing and adding each ingredient. Labor and general operating costs would also be reduced substantially as only one addition need be made.

THE SUMMARY OF THE INVENTION

The compositions disclosed herein overcome the aforementioned deficiencies of the prior art. The present invention provides novel stable homogeneous liquid compositions and dry solid compositions for simultaneously souring and imparting softness to freshly laundered textile materials. In one variant, stable homogeneous aqueous liquid compositions are provided which contain certain specific softening agents and inorganic souring agents compatible therewith such as hydrofluorosilicic acid, ammonium silicofluoride, zinc silicofluoride, ammonium acid fluoride, potassium acid fluoride, and orthophosphoric acid. Stable dry solid compositions are also provided which contain certain specific softening agents and inorganic souring agents compatible therewith such as ammonium silicofluoride, potassium silicofluoride, sodium silicofluoride, zinc silicofluoride, ammonium acid fluoride, sodium acid fluoride or potassium acid fluoride. The ingredients of the liquid compositions are preferably admixed by the novel method of the invention to prevent precipitation or separation of a nonhomogeneous phase. It is also possible to prepare novel homogeneous stable aqueous stock solutions from the liquid or solid compositions of the invention.

The drawings, the following detailed description and the specific examples may be referred to for a more complete and comprehensive understanding of the invention.

THE BRIEF DESCRIPTION OF THE DRAWINGS

Figure 2:
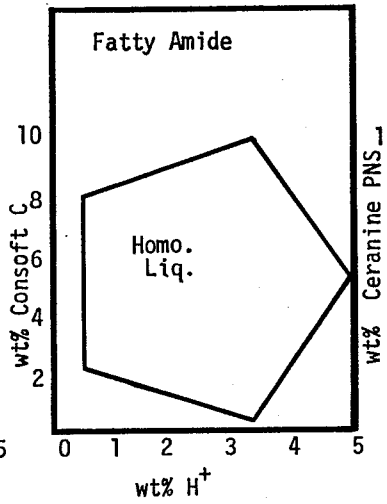
Figure 3:
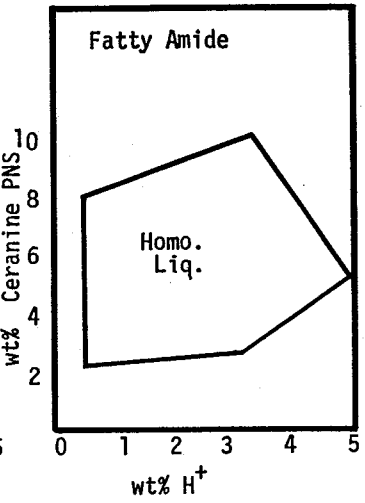
Figure 4:
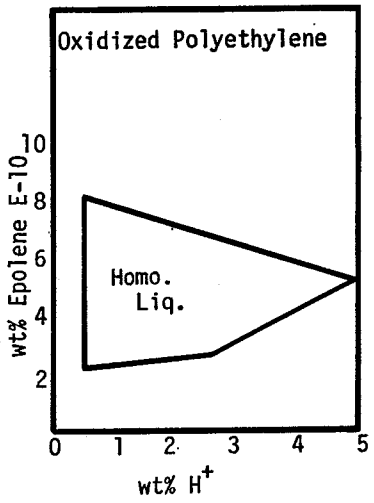
Figure 5:
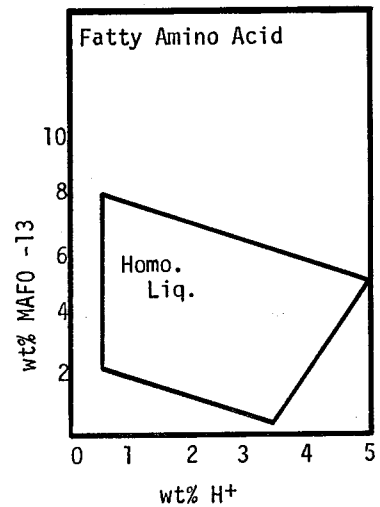
Figure 6:
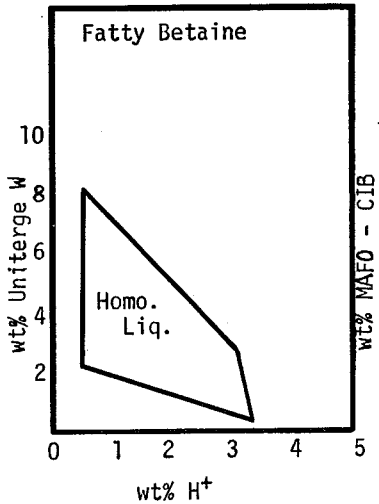
Figure 7:
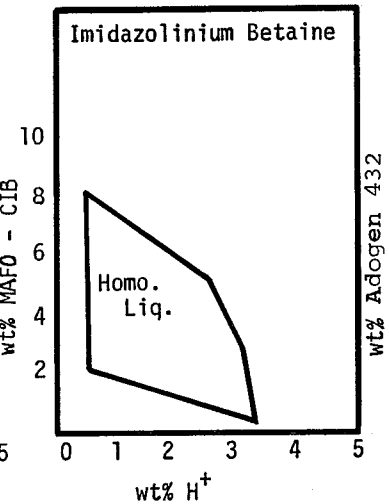
Figure 8:
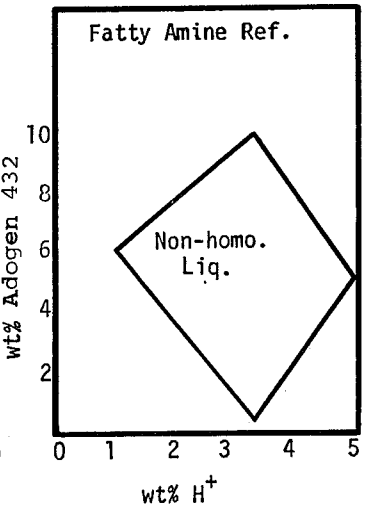

FIGS. 1 through 8 of the drawings are graphs which illustrate the data obtained in accordance with the procedure of Example I for each of the softening agents noted therein.

THE DETAILED DESCRIPTION OF THE INVENTION INCLUDING THE PREFERRED VARIANTS AND EMBODIMENTS THEREOF

In accordance with one presently preferred variant of the invention, stable homogeneous liquid compositions for souring freshly laundered textile materials and imparting softeness thereto are provided which contain about 0.5–25% by weight and preferably about 1–15% by weight of a softening agent, about 3–50% by weight and preferably about 3–25% by weight of an inorganic souring agent, and about 25–96.5% by weight and preferably about 60–96% by weight of water. In accordance with another presently preferred variant of the invention, stable dry solid compositions for souring freshly laundered textile materials and imparting softness thereto are provided which contain about 5–50% by weight and preferably about 15–30% by weight of a softening agent, and about 50–95% by weight and preferably about 70–85% by weight of an inorganic souring agent. It will be appreciated that there are certain other preferred variants and embodiments of the invention which are discussed in greater detail hereinafter. All quantities and percentages mentioned herein including the claims are calculated on a weight basis unless specifically indicated to the contrary.

The aforementioned liquid composition of the invention contains one of the following softening agents for textile materials or admixtures of two or more of such softening agents;

(A) Quaternized fatty amides corresponding to the following structural formulae:

1.

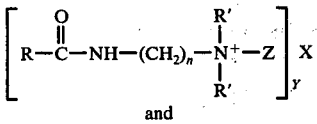

and

2.

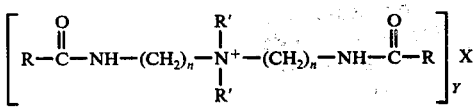

wherein R is selected from the group consisting of monovalent alkyl radicals and sulfonated monovalent alkyl radicals containing about 8–22 carbon atoms, R′ is selected from the group consisting of monovalent alkyl radicals and sulfonated monovalent alkyl radicals containing about 1–3 carbon atoms, Z is selected from the group consisting of monovalent alkyl radicals and sulfonated monovalent alkyl radicals containing 1–22 carbon atoms, *n* is about 1–6, X is an anion selected from the group consisting of halide, sulfate, phosphate, alkyl sulfates having about 1–3 carbon atoms in the alkyl group and alkyl phosphates having about 1–3 carbon atoms in the alkyl group, and Y is an integer having a numerical value equivalent to the valency of X;

(B) An aqueous emulsion of partially oxidized emulsifiable polyethylene having a molecular weight of about 1000–10,000;

(C) Fatty amphoteric compounds corresponding to the structural formula

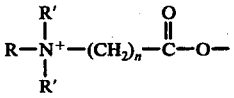

wherein R, R′ and *n* are as defined in (A) above, the said amphoteric compounds having non-acidic isoelectric ranges; and (D) Fatty amides corresponding to the structural formula

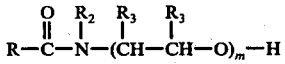

wherein R is as defined in (A) above, $R_2$ is selected from the group consisting of hydrogen and

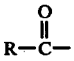

wherein R is as defined in (A) above, $R_3$ is selected from the group consisting of hydrogen and monovalent alkyl radicals containing 1–2 carbon atoms, and *m* is 2–6.

The liquid composition also contains hydrofluorosilicic acid, ammonium silicofluoride, zinc silicofluoride, ammonium acid fluoride, potassium acid fluoride or orthophosphoric acid as an acidic souring agent for freshly laundered textile materials, or admixtures of two or more of such souring agents.

In the foregoing structural formulae, R is preferably a monovalent alkyl radical containing about 12–18 carbon atoms and for still better results about 17 or 18 carbon atoms. R′ is preferably a monovalent alkyl radical containing one carbon atom, Z is preferably a monovalent alkyl radical containing either about 1 or about 12–18 carbon atoms, and *n* preferably is an integer having a numerical value of about 1–3 and for still better results about 1. $R_2$ is preferably

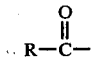

wherein R is preferably as defined above, and $R_3$ is preferably hydrogen. X is preferably halide and in many instances is chloride. The numerical value of Y varies with the valence of X and may be 1, 2 or 3 depending upon the selected anion. The material value of *m* is preferably 2–3.

The molecular weight of the partially oxidized polyethylene in the aqueous emulsion is preferably about 1,400 – 5,000 and may be about 2,500 for still better results. The density is preferably about 0.93–1.05 and the carboxyl content may be, for example, about 0.2–2 milliequivalents per gram. The solids content of the emulsion may vary over wide ranges and may be, for example, about 5–50% by weight and preferably about 25% by weight. In calculating the amount of the emulsion to be used as a softening agent, it is understood that the calculations are made on a dry solids basis. The emulsifying agent for the emulsion may be a cationic, anionic or nonionic synthetic surfactant and is preferably a cationic synthetic surfactant. The emulsifying agent may be present in an amount of about 1–25% by weight and preferably about 5–10% by weight based upon the weight of the partially oxidized polyethylene. The partially oxidized polyethylene in one presently preferred emulsion has a ring and ball softening point of 223° F., a penetration (100 grams for 5 seconds) of 0.22 millimeter, a density of 0.940 g/cc, a Brookfield viscosity at 302° F. of 1,300 cps, a molecular weight of 2,500 and an acid number of 14.

The quaternized fatty amides, the fatty amphoteric compounds and the fatty amides disclosed herein are well known commercially available products and may be prepared in accordance with the usual prior art processes. The aqueous emulsion of partially oxidized polyethylene is likewise a commercially available product and it also may be prepared by the usual prior art processes. Examples of emulsions of partially oxidized polyethylene and the preparation thereof are disclosed in a number of United States Patents including Nos. 3,442,694 and 3,475,207, the disclosures of which are incorporated herein by reference.

The liquid composition preferably contains a fatty amide of the structure disclosed in subparagraph (D) as the softening agent and hydrofluorosilicic acid and/or ammonium acid fluoride as the souring agent when freeze-thaw stability is not required. In instances where freeze-thaw stability is of importance, then the liquid composition preferably contains a fatty amphoteric compound as a softening agent and hydrofluorosilicic acid as the souring agent. The latter liquid composition reconstitutes upon freezing and thawing and a precipitate or other nonhomogeneous phase is not formed.

When preparing the liquid composition using a fatty amide or a quaternized fatty amide as the softening agent, it is essential that the fatty amide or quaternized fatty amide be dissolved or dispersed uniformity in the water prior to addition of the souring agent. Otherwise, the fatty amide or quaternized fatty amide will precipitate and the liquid composition will not be stable and homogeneous over a sufficient period of time. It is also preferred that the liquid composition be prepared following this procedure in instances where the softening agent is a fatty amphoteric compound or an aqueous emulsion of partially oxidized polyethylene.

It is understood that the aforementioned ingredients are present in proportions and in concentrations whereby a stable homogeneous liquid composition is produced. In most instances, the preferred concentrations and proportions of the ingredients may be determined by the Box or Factorial Method of Experimental Design. Suitable procedures for making such determinations are disclosed in the text *Design and Analysis of Industrial Experiments,* edited by Owen L. Davies, and published by the Hafner Publishing Company, New York, N.Y. (1956), the disclosure of which is incorporated herein by reference. This test has been assigned Library of Congress Card No. T 175.D 3. Chapters 10 and 11, i.e., pages 440–578, are especially pertinent.

The aforementioned solid composition of the invention contains a fatty amide, a quaternized fatty amide or a fatty amphoteric compound, or two or more of these substances. The fatty amides, the quaternized fatty amides, and the fatty amphoteric compounds correspond to the structural formulae described previously for the liquid composition. The solid composition also contains ammonium silicofluoride, potassium silicofluoride, sodium silicofluoride, zinc silicofluoride, ammonium acid fluoride, sodium acid fluoride or potassium acid fluoride as an acidic souring agent for the freshly laundered textile materials, or admixtures of two or more of these souring agents. Inasmuch as the fatty amides, the quaternized fatty amides, the fatty amphoteric compounds and the souring agents are dry solids and are compatible, the solid composition may be prepared by uniformly admixing the ingredients in the proportions and concentrations disclosed herein to thereby produce a stable substantially homogeneous solid composition.

In instances where the solid composition is to be admixed with water to prepare a stock solution, then the preferred softening agent in a fatty amphoretic compound and the preferred souring agent is ammonium silicofluoride, zinc silicofluoride, ammonium acid fluoride, potassium acid fluoride or admixtures thereof. Otherwise, the softening agent tends to precipitate and thus the stock solution is not stable and homogeneous over a sufficient period of time. When the souring agent is sodium or potassium silicofluoride, it is not sufficiently soluble to prepare a concentrated stock solution although dilute use solutions may be prepared. The liquid and solid compositions of the invention are stable and homogeneous, and may be stored for sufficient use periods. Either composition may be added directly to the addition wheel of modern commercial washers. Inasmuch as the compositions are homogeneous or substantially homogeneous, additions in the exact required amounts of the active softening and souring chemical may be made at the proper time in the washing cycle using automatic prior art metering or measuring apparatus and timing devices. Only the one addition need be made for the souring agent and the softening agent, and thus the auxiliary apparatus needed for storing, handling and adding softening and souring chemicals is reduced by approximately one-half. Also, the labor and inventory costs are lower thereby effecting further economies in the overall laundering operation. The compositions of the present invention also assure that the softening agent and souring agent are added in the proper proportions, as well as in the proper concentrations, thereby simplifying the addition procedure. Unskilled personnel may be relied upon for making the proper additions.

The liquid and solid compositions of the invention may be added to the final rinse water, or they may be added at other suitable times in the washing cycle. Conventional practice may be followed with the exception of substituting one addition of a composition of the invention for the two additions of the softening agent and souring agent of the prior art. The compositions are added in amounts sufficient to provide the usual prior art quantities of active softening agent and active souring agent. For example, the liquid or solid composition may be added to the final rinse water in an amount to provide approximately 0.25–5 ounces and preferably about 0.25–3.0 ounces of the active softening agent and about 0.5–5 ounces and preferably about 1–2 ounces of the active souring agent per 100 pounds of dry textile material. While these quantities of softening agent and souring agent are generally satisfactory, it is understood that larger or smaller amounts may be added as needed in a specific instance.

The foregoing detailed description and the following specific examples are for purposes of illustration only, and are not intended as being limiting to the spirit or scope of the appended claims.

EXAMPLE I

This examples illustrates the preparation of stable homogeneous aqueous solutions containing varying concentrations of eight commercially available compositions of textile softening agents and hydrofluorosilicic acid. The concentrations were determined by the Box Method of Experimental Design, as discussed by J. S. Hunter in the publication entitled "The Box Method of Experimentation", February, 1957 (Princeton University). Aqueous solutions containing varying concentrations of each textile softening agent and hydrofluorosilicic acid were prepared and the physical states of the resultant mixtures were observed.

The eight commercially available compositions of textile softening agents and pertinent data thereon are given below in Table I.

Table I

| Commercially available softening agent | Type of softening Agent | Wt. % active softening agent |
|---|---|---|
| Verisoft 222® | sulfonated quaternized fatty amide | 75% |
| Consoft C® | quaternized fatty amide | 20% |
| Ceranine PNS® | fatty amide | 100% |
| Epolene E-10® | oxidized polyethylene emulsion | 25% |
| MAFO-13® | fatty amino acid | 60% |
| Uniterge W® | fatty betaine | 40% |
| MAFO-CIB® | imidazolinium betaine | 40% |
| Adogen 432® | dialkyl dimethyl ammonium chloride (reference) | 66.7% |

The data obtained for each of the eight softening agents appearing above, namely, Verisoft 222®, Consoft C®, Ceranine PNS®, Epolene E-10, MAFO-13®, Uniterge W®, MAFO-CIB®, and Adogen 432 ®, appear in the form of graphs illustrated as FIGS. 1 through 8, respectively, in the drawings. It may be noted that the fatty amide and the quaternized fatty amides produced homogeneous aqueous solutions with hydrofluorosilicic acid. However, the quaternized fatty amine reference did not.

EXAMPLE II

This example demonstrates that the fatty amides, the quaternized fatty amides, the emulsion of oxidized polyethylene and the fatty amphoteric compounds of the invention are substantive to textile materials. As is generally accepted, the more substantive a textile softener is to the textile material, the greater is the water repellency imparted thereto.

Terry Cloth swatches weighing approximately 3 grams were treated with varying concentrations of the textile softener compositions in a Launder-ometer at 100° F. The treated swatches were hydroextracted and then tumble dried. Thereafter, the swatches were tested for absorbency by partially immersing them in a standard blue dye solution and determining the time in seconds required for the solution to wick two inches up the swatches. The more substantive softening agents result in longer wicking times.

The data thus obtained are discussed in the numbered paragraphs appearing below:

1. A sulfonated quaternized fatty amide composition sold under the tradename "Verisoft 222 ®" was tested in this run. Verisoft 222 contains 75% by weight of active softening agent and respective concentrations of 0.5 ounce and 1.0 ounce per 100 pounds of textile material were used in treating two swatches. The wicking times for the two swatches were 500 and more than 1000 seconds, respectively.

2. A swatch was treated with a commercially available quaternized fatty amide softening agent sold under the tradename Consoft C ®. The composition contained 20% by weight of active softening agent and the swatch was treated at a concentration of 0.5 ounce per 100 pounds of textile material. The wicking time was more than 1000 seconds.

3. Two swatches were treated with a commercially available composition of a fatty amide sold under the tradename Ceranine PNS ®. The composition contained 100% of active softening agent and the two swatches were treated at respective concentrations of 0.5 ounce and 1 ounce per 100 pounds of textile material. The wicking times were 150 and more than 1000 seconds, respectively.

4. Three swatches were treated with an emulsion of oxidized polyethylene sold under the tradename Epolene E-10. The emulsion contained 25% by weight of the oxidized polyethylene and the three swatches were treated at concentrations of 0.5, 1.0 and 2.0 ounces per hundredweight of textile material, respectively. The wicking times were 330, 630 and more than 1000 seconds, respectively.

5. Five swatches were treated with a commercially available fatty amino acid sold under the tradename MAFO-13. The composition contained 60% by weight of active softening agent and the swatches were treated at concentrations of 0.5, 2.0, 4.0 and 5 ounces per 100 pounds of textile material. The wicking times were 350, 230, 600, 700 and more than 1000 seconds respectively.

6. Six swatches were treated with a commercially available fatty betaine composition sold under the tradename Uniterge W ®. The composition contained 40% of active softening agent and the six swatches were treated at concentrations of 0.5, 1.0, 2.0, 4.0 and 5.0 ounces per 100 pounds of textile material, respectively. The wicking times were 300, 380, 640, 600, 940 and more than 1000 seconds respectively.

7. Three swatches were treated with a commercially available imidazolinium betaine composition sold under the tradename MAFO-CIB. The compositions contain 40% of active softening agent and the three swatches were treated with concentrations of 1.0, 4.0, and 5.0 ounces per 100 pounds of textile material, respectively. The wicking times were 50, 340 and 600 seconds, respectively.

8. One swatch was treated with a commercially available composition containing a fatty amine to provide a reference sample. The composition contained 25% of active softening agent and the swatch was treated at a concentration of 0.5 ounce per 100 pounds of textile material. The wicking time was more than 1000 seconds.

EXAMPLE III

This example illustrates the softening capacities of the eight commercially available compositions of softening agents which were used in the preceding example.

Terry Cloth swatches were treated in the same manner as in the substantivity tests of Example II. The treated samples were then placed in numerical order based upon their softness by a panel of eight judges. The best rating was 1 and the poorest rating was 8. The data thus obtained appear below in Table II.

TABLE II

| Trade Name | Designated Softness | Conc. (oz/cwt) (textile) | Softness of Quaternary Amine Equiv. | Quaternary fatty amine Conc. (oz/cwt) (textile) |
|---|---|---|---|---|
| Verisoft 222® | 1.5 | ½ | — | — |
| " | 1.5 | 1 | 1 | 1 |
| Consoft C® | 3.8 | 1 | 4.8 | 1 |
| " | 1.8 | 3 | | |
| Ceranine PNS® | 3.6 | 1 | 1.6 | 1 |
| " | 2.6 | 5 | | |
| Epolene E-10® | 3.1 | 1 | 2.3 | 1 |
| " | 1.5 | 2 | | |
| MAFO - 13® | 3.3 | 1 | 1 | 1 |
| Uniterge W® | 3.7 | 1 | 4.3 | 1 |
| " | 1.7 | 3 | | |
| MAFO - CIB® | 3.1 | 1 | 1.2 | 1 |

Explanation of Softness Ratings
1.0 – 1.6 : Excellent softening effect
1.7 – 3.3 : Good softening effect
3.4 – 5.0 : Sufficient softening effect
5.1 – 6.7 : Poor softening effect
6.8 – 8.0 : No softening effect

EXAMPLE IV

This example illustrates the use of a liquid souring-softening composition containing 4.8% by weight of a fatty amino acid commercial softening agent sold under the tradename MAFO 13 ®, 3.4% by weight of hydrofluorosilicic acid and the remainder water for simultaneously souring and softening freshly laundered textile materials.

A 25 pound Milnor Washer-Extractor was used in this example. A wash net was filled with 25 pounds of Dacron-cotton filler. Swatches of 4 inch × 4 inch Terry Cloth were also placed in the net and the filled net was placed in the washer. The washer was filled with 6 inches of water having a temperature of 160° F., 4 ounces of a mixture containing equal weights of sodium carbonate and anhydrous sodium metasilicate was added, and the load was washed for a period of 30 minutes. During the second or carry over operation which followed, the washer was run for 5 minutes at the 6 inch water level. The water had a temperature of 100° F., and no chemicals were added. The third operation was carried out for 2 minutes using the flush 12 inch water level. The water had a temperature of 160° F and no chemicals were added.

The fourth operation was the bleach using trichlorocyanuric acid as the bleaching agent. The water level was 6 inches, the temperature was 160° F., and the bleaching time was 7 minutes. The bleach was followed by the fifth and sixth operations which were rinses. The water level was twelve inches in each rinse, the water temperature was 140° F and 120° F respectively, and the rinse time was 2 minutes in each rinse.

The seventh operation was the souring-softening step and several of the washed swatches were removed for use in the tests which follow. The water level was 6 inches and the water temperature was 100° F. The souring-softening addition was 25 fluid ounces of the liquid souring-softening composition previously described. The souring-softening composition was added in an amount to provide 4.8 ounces of the active softening agent per hundredweight of textile material, and 3.4 ounces of the active souring agent per hundredweight of textile material. The load was thereafter hydroextracted for thirty seconds and tumble dried.

The pH of the wash water was 11.8. The pH of the water from the souring-softening operation was 3.4 thereby indicating a reversal in pH. The pH of the washed textile material was 5–5.4 which demonstrates that it was properly soured.

Four sets of swatches were prepared containing one of the softened swatches and one of the untreated swatches. The four sets of swatches were examined by different individuals and each immediately distinguished between the softened swatch and the untreated swatch. Thus, the treated swatches were adequately softened.

The above swatches were further tested in a standard wicking test. A dye solution was prepared and the samples were partially immersed therein. The time required for the dye solution to wick 2 inches up on the swatch was determined in seconds. The untreated swatches wicked 2 inches after 25–30 seconds. The softened swatches wicked 2 inches in an average of 129–130 seconds, thereby demonstrating that the softening agent is substantive to the fabric.

EXAMPLE V

The general procedure of Example IV was repeated up to the seventh operation, i.e., the souring-softening operation. The souring-softening operation in this example employed a dry uniform admixture containing 30% by weight of a fatty amide sold under the tradename Ceranine PNS® and 70% by weight of hydrofluorosilicic acid. The souring-softening composition was added in an amount to provide 1.2 ounces of the active softening agent and 2.8 ounces of the active souring agent per 100 pounds by weight of textile material.

The pH of the wash water was 11.0, and the pH of the water following the souring-softening operation was 3.8. The pH of the textile material following souring was 4.5–5.5.

The swatches were tested for softness following the general procedure of Example IV and comparable results were obtained. The softened swatches were much softer and the individuals were able to distinguish immediately between the softened swatches and the untreated swatches. The wicking test of Example IV was repeated on the swatches produced in this Example. The softened samples required more than 1000 seconds to wick 2 inches, whereas the untreated swatches wicked in approximately 25–30 seconds.

We claim:

1. A stable homogeneous liquid composition for souring laundered textile materials and imparting softness thereto consisting essentially of:

I. About 0.5–25% by weight of a softening agent for textile materials, the said softening agent consisting of a fatty amide corresponding to the structural formula

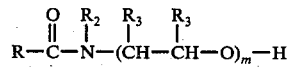

wherein R is selected from the group consisting of monovalent alkyl radicals and sulfonated monovalent alkyl radicals containing about 8–22 carbon atoms, $R_2$ is selected from the group consisting of hydrogen and

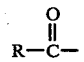

wherein R is as defined above, $R_3$ is selected from the group consisting of hydrogen and monovalent alkyl radicals containing 1–2 carbon atoms, and *m* is 2–6;

II. About 3–50% by weight of an acidic souring agent for laundered textile materials selected from the group consisting of hydrofluorosilicic acid, ammonium silicofluoride, zinc silicofluoride, ammonium acid fluoride, potassium acid fluoride and orthophosphoric acid; and III. About 25–96.5% by weight of water;

the said ingredients I, II and III being present in amounts whereby a stable homogeneous liquid composition is produced.

2. The liquid composition of claim 1 wherein the softening agent is present in an amount of about 1–15% by weight.

3. The liquid composition of claim 1 wherein the souring agent is present in an amount of about 3–25% by weight.

4. The liquid composition of claim 1 wherein the softening agent is present in an amount of about 1–15% by weight, the souring agent is present in an amount of about 3–25% by weight, and the water is present in an amount of about 60–96% by weight.

5. The liquid composition of claim 1 wherein the souring agent comprises hydrofluorosilicic acid.

6. The liquid composition of claim 1 wherein the souring agent comprises ammonium acid fluoride.

7. The liquid composition of claim 1 wherein R is a monovalent alkyl radical containing about 12–18 carbon atoms.

8. The liquid composition of claim 1 wherein *m* is 2–3.

9. The liquid composition of claim 1 wherein $R_2$ is hydrogen.

10. The liquid composition of claim 1 wherein $R_2$ is $$R-\overset{\overset{\displaystyle O}{\|}}{C}-$$

and R is a monovalent alkyl radical containing about 8–22 carbon atoms.

11. The liquid composition of claim 1 wherein $R_3$ is hydrogen.

12. The liquid composition of claim 1 wherein $R_3$ is a monovalent alkyl radical containing 1–2 carbon atoms.

13. The liquid composition of claim 1 wherein R is a monovalent alkyl radical containing about 12–18 carbon atoms and *m* is 2–3.

14. The liquid composition of claim 13 wherein $R_2$ is hydrogen.

15. The liquid composition of claim 14 wherein $R_3$ is hydrogen.

16. The liquid composition of claim 14 wherein $R_3$ is a monovalent alkyl radical containing 1–2 carbon atoms.

17. The liquid composition of claim 13 wherein $R_2$ is $$R-\overset{\overset{\displaystyle O}{\|}}{C}-.$$

18. The liquid composition of claim 17 wherein $R_3$ is hydrogen.

19. The liquid composition of claim 17 wherein $R_3$ is a monovalent alkyl radical containing 1–2 carbon atoms.

20. The liquid composition of claim 1 wherein R is a monovalent alkyl radical containing 17 carbon atoms, $R_2$ is $$R-\overset{\overset{\displaystyle O}{\|}}{C}-,$$

$R_3$ is hydrogen and *m* is 2.

21. The liquid composition of claim 1 wherein R is a monovalent alkyl radical containing 17 carbon atoms, $R_2$ is hydrogen, $R_3$ is hydrogen and *m* is 2.

22. The liquid composition of claim 1 wherein R is a monovalent alkyl radical containing 17 carbon atoms, $R_2$ is $$R-\overset{\overset{\displaystyle O}{\|}}{C}-,$$

$R_3$ is hydrogen, *m* is 2, and the said souring agent is hydrofluorosilicic acid.

23. A method of preparing the stable homogeneous liquid composition of claim 1 wherein the said softening agent is admixed in water to form a homogeneous admixture thereof and thereafter the said souring agent is admixed therein to form the said stable homogeneous liquid composition.

24. The method of claim 23 wherein the said souring agent comprises hydrofluorosilicic acid.

25. The method of claim 23 wherein the said souring agent comprises ammonium acid fluoride.

26. A stable homogeneous aqueous stock solution for souring laundered textile materials prepared by diluting the liquid composition of claim 1 with water.

27. A stable homogeneous aqueous stock solution for souring laundered textile materials prepared by diluting the liquid composition of claim 5 with water.

28. A stable homogeneous aqueous stock solution for souring laundered textile materials prepared by diluting the liquid composition of claim 6 with water.

29. A stable homogeneous aqueous stock solution for souring laundered textile materials prepared by diluting the liquid composition of claim 20 with water.

30. A stable homogeneous aqueous stock solution for souring laundered textile materials prepared by diluting the liquid composition of claim 21 with water.

31. A stable homogeneous aqueous stock solution for souring laundered textile materials prepared by diluting the liquid composition of claim 22 with water.

32. A stable dry solid composition for souring laundered textile materials and imparting softness thereto consisting essentially of:

I. About 5–50% by weight of a softening agent for textile materials, the said softening agent consisting of a fatty amide corresponding to the structural formula $$R-\overset{\overset{\displaystyle O}{\|}}{C}-\overset{\overset{\displaystyle R_2}{|}}{N}-(\overset{\overset{\displaystyle R_3}{|}}{CH}-\overset{\overset{\displaystyle R_3}{|}}{CH}-O)_m-H$$

wherein R is selected from the group consisting of monovalent alkyl radicals and sulfonated monovalent alkyl radicals containing about 8–22 carbon atoms, $R_2$ is selected from the group consisting of hydrogen and $$R-\overset{\overset{\displaystyle O}{\|}}{C}-$$

wherein R is as defined above, $R_3$ is selected from the group consisting of hydrogen and monovalent alkyl radicals containing 1–2 carbon atoms, and *m* is 2–6; and II. About 95–50% by weight of an acidic souring agent for laundered textile materials selected from the group consisting of ammonium silicofluoride, potassium silicofluoride, sodium silicofluoride, zinc silicofluoride, ammonium acid fluoride, sodium acid fluoride and potassium acid fluoride, the said ingredients I and II being present in amounts whereby a stable solid composition is produced for souring freshly laundered textile materials and imparting softness thereto.

33. The dry solid composition of claim 32 wherein about 15–30% by weight of the softening agent and about 70–85% by weight of the souring agent are present.

34. The dry solid composition of claim 32 wherein the souring agent is selected from the group consisting of ammonium silicofluoride, zinc silicofluoride, ammonium acid fluoride and potassium acid fluoride.

35. The dry solid composition of claim 32 wherein R is a monovalent alkyl radical containing about 12–18 carbon atoms.

36. The dry solid composition of claim 32 wherein *m* is 2–3.

37. The dry solid composition of claim 32 wherein $R_2$ is hydrogen.

38. The dry solid composition of claim 32 wherein $R_2$ is $$R-\overset{\overset{\displaystyle O}{\|}}{C}-$$

and R is a monovalent alkyl radical containing about 8–22 carbon atoms.

39. The dry solid composition of claim 32 wherein $R_3$ is hydrogen.

40. The dry solid composition of claim 32 wherein $R_3$ is a monovalent alkyl radical containing 1–2 carbon atoms.

41. The dry solid composition of claim 32 wherein R is a monovalent alkyl radical containing about 12–18 carbon atoms and *m* is 2–3.

42. The dry solid composition of claim 41 wherein $R_2$ is hydrogen.

43. The dry solid composition of claim 42 wherein $R_3$ is hydrogen.

44. The dry solid composition of claim 42 wherein $R_3$ is a monovalent alkyl radical containing 1–2 carbon atoms.

45. The dry solid composition of claim 41 wherein $R_2$ is $$R-\overset{\overset{\displaystyle O}{\|}}{C}-.$$

46. The dry solid composition of claim 45 wherein $R_3$ is hydrogen.

47. The dry solid composition of claim 45 wherein $R_3$ is a monovalent alkyl radical containing 1–2 carbon atoms.

48. The dry solid composition of claim 32 wherein R is a monovalent alkyl radical containing 17 carbon atoms, $R_2$ is $$R-\overset{\overset{\displaystyle O}{\|}}{C}-,$$

$R_3$ is hydrogen and *m* is 2.

49. The dry solid composition of claim 32 wherein R is a monovalent alkyl radical containing 17 carbon atoms, $R_2$ is hydrogen, $R_3$ is hydrogen and *m* is 2.

50. The dry solid composition of claim 32 wherein R is a monovalent alkyl radical containing 17 carbon atoms, $R_2$ is $$R-\overset{\overset{\displaystyle O}{\|}}{C}-,$$

$R_3$ is hydrogen, *m* is 2, and the said souring agent is ammonium silicofluoride

51. The liquid composition of claim 1 wherein the said souring agent is orthophosphoric acid.

52. The liquid composition of claim 22 wherein the said souring agent is orthophosphoric acid.

53. The method of claim 23 wherein the said souring agent is orthophosphoric acid.

54. A stable homogeneous aqueous stock solution for souring laundered textile materials prepared by diluting the liquid composition of claim 51 with water.

* * * * *